United States Patent [19]

Strugala et al.

[11] 4,326,397

[45] Apr. 27, 1982

[54] MULTIPLE MANDREL-RING ROLLING MACHINE

[75] Inventors: Alfred Strugala; Robert Schilling, both of Dortmund; Dieter Adamaszek, Kamen, all of Fed. Rep. of Germany

[73] Assignee: Thyssen Industrie AG, Fed. Rep. of Germany

[21] Appl. No.: 141,767

[22] Filed: Apr. 21, 1980

[30] Foreign Application Priority Data

Apr. 28, 1979 [DE] Fed. Rep. of Germany ..... 2917369

[51] Int. Cl.[3] ..... B21H 1/06

[52] U.S. Cl. ..... 72/110; 72/106

[58] Field of Search ..... 72/94, 105, 106, 107, 72/110, 111, 84

[56] References Cited

U.S. PATENT DOCUMENTS 2,567,334 9/1951 Harrison et al. ..... 72/105

3,815,402 6/1974 Duran et al. ..... 72/94

FOREIGN PATENT DOCUMENTS 2615802 10/1977 Fed. Rep. of Germany ..... 72/110

*Primary Examiner*—Lowell A. Larson

*Attorney, Agent, or Firm*—McGlew and Tuttle

[57] ABSTRACT

A multiple-mandrel ring rolling machine for producing a ring from a ring blank having a plurality of elongated mandrel rolls rotatably mounted on a rolling platform fixedly mounted to a frame for rotation relative thereto is disclosed. The mandrel rolls are axially displaceable relative to the rolling platform between a first position above the rolling platform for rolling a ring blank and a second position below the rolling platform.

13 Claims, 2 Drawing Figures

MULTIPLE MANDREL-RING ROLLING MACHINE

FIELD AND BACKGROUND OF THE INVENTION

The invention relates, in general, to metal forming and, more particularly, to a multiple-mandrel ring rolling machine for hot rolling rings of a small to medium diameter, for example, roller bearing rings.

German Pat. No. 438,542 discloses machines where the main roll is mounted immovably in the rolling machine frame. The roll mandrels, disclosed therein, are mounted laterally of the main roll in overhung position in a rolling platform either rotating in a rolling machine frame or movable on a rolling machine frame. The roll mandrels can be brought successively into rolling position by rotation or displacement, or can be fed to the main roll and removed from the latter.

German Pat. No. 703,436 discloses a multiple-mandrel ring rolling machine having a support for the mandrel roll axle, on both sides thereof, in a rolling platform arranged laterally of the main roll. An automatic stripping of the finished-rolled ring from the rolling platform is made possible, in this way, so that the mandrel rolls, due to the two-part design of the mandrel roll axle, can be lifted upward from the rolling platform, and a stripper pushes the finished rolled ring from the rolling platform.

In addition, a multiple mandrel ring rolling machine, disclosed in German Pat. No. 1,098,481 has a rolling platform for carrying the mandrel rolls which is mounted for rotation about the main roll.

These known multiple-mandrel ring rolling machines, which are effective as far as the number of rings produced is concerned, generally have drawbacks. A reliable automatic change of the workpieces, which is highly desirable for maximizing the output of the machines, is impeded by the fact that the rolling platform having the mandrel rolls can either only stand still for a very short time because of the necessary cycles required for machining the rings, or runs continuously, though at a reduced speed. In addition, the mandrel rolls, which are mounted with a split axle in the interest of a rapid change of the workpieces, as well as the mandrel rolls mounted unilaterally or in overhung position, lack the rigid support necessary for obtaining precision ring dimensions so that considerable deviations from the nominal values, depending on the variable factors affecting the use, must be acceptable in the rings produced on these ring rolling machines. Moreover, the semi-automatic change of workpieces in these machines requires a great engineering effort and large revolving masses, while the machines show little functional clarity and are not easily accessible, so that they are on the whole not suitable for high demands regarding accuracy to the form and measure of the rings with short cycle times. Furthermore, the mandrel roll is fed, in the known multiple-mandrel ring rolling machine, relative to the main rolls by a fixed amount normally determined by the rotation of the rolling platform. This does not permit rapid and automatic corrections so that the diameters of the finished rings vary within the volume of the ring blanks used. Finally, the use of axial rolls requires, in multiple-mandrel ring rolling machines of the known type, a great expenditure of effort for achieving the vertical calibration of the rings so that utilizing this possibility to increase quality had to be foregone in the past.

SUMMARY OF THE INVENTION

The invention addresses the problem of improving a multiple-mandrel ring rolling machine, in such a way, as to avoid the above-mentioned disadvantages and to increase production relative to cycle time as well as improving the precision of the finished workpieces relative to those produced by the presently-known multiple-mandrel ring rolling machines, while ensuring a reliable feed by the machine itself with little engineering effort.

In accordance with the invention, a multiple mandrel ring rolling machine having a disk roll driven as a main roll is mounted in a rolling machine frame. Several elongated mandrel rolls are rotatably mounted in a rotatable rolling platform. Each end of the elongated mandrel roll is supported when it is in an operating position. Each of the elongated mandrel rolls can be moved into rolling position by rotation of the rolling platform. The machine is particularly characterized in that the mandrel rolls are displaceable in axial direction and lockable at different levels relative to the rolling platform. The mandrel rolls can be lowered below the level of the rolling platform.

It is an advantage of such a ring rolling machine, in accordance with the invention, that an automatic change of the workpieces as well as automatic feeding of the workpieces by the machine itself, may be effected. Moreover, the mandrel roll, which is in a loading position during the rolling process, is lowered below the level of the rolling platform so that a ring blank can be applied on the rolling platform in a simple manner, for example, by a horizontally working slide (the so-called pusher). After the ring blank has been positioned, the respective mandrel roll is raised until it penetrates through the hole of the ring blank. This assures that the ring blank will be positively brought into the provided rolling position by rotating the rolling platform. In the rolling position, the mandrel roll is moved up into an upward end position, so that its rolling surface bears on the inside of the ring blank in a vertical plane, whose position is determined by the centers of the mandrel roll and of the main roll, and the mandrel roll axle engages, if necessary, with its upper end the upper step bearing provided for this purpose. After the rolling process is completed, the rolling platform is turned by ninety degrees so that the finish-rolled ring arrives in the unloading position. If another step bearing for the mandrel roll is provided in the rolling machine, the mandrel roll is only lowered so far that its axle clears this step bearing. In this position, the respective mandrel roll is lowered below the surface of the rolling platform only so far that it does not hinder the removal of the ring, without the ring having to be raised, pushing it laterally by means of a slide, stripper from the rolling platform.

In a preferred embodiment of the invention, the rolling platform is mounted stationary in the rolling machine frame, and the main roll is mounted in a carriage, displaceably guided on the rolling machine frame, which can be fed toward the mandrel roll in rolling position. The rolling mill designed in the above-described manner has the advantage that the mass of the moving machine parts is reduced to an optimum small size so that the switching steps, the feeding movements and the opening movements of the machine can be performed rapidly and accurately. Another advantage of the inventive arrangement is that the rolling platform stands still during the rolling operation so that there is sufficient time for a safe change of workpieces and for lubricating and cooling the mandrel rolls which are not in rolling position.

The rolling machine, according to the invention, permits with little additional expenditure a rigid support of both ends of the mandrel roll which is in rolling position. To this end, in one embodiment of the invention, an immovable supporting arm is secured on the rolling machine frame. A bearing, for the free end of the axle of the mandrel roll in rolling position, is arranged on the arm at a predetermined distance above the rolling platform. As soon as a mandrel roll has reached an opposite position to the main roll by rotating the rolling platform, it is raised into rolling position and its free axle end is inserted into the bearing arranged on the supporting arm, so that the mandrel roll is no longer mounted in an "overhung position" but on both sides, and the rolling precision is considerably greater than that achieved when the mandrel roll is merely mounted in overhung position.

In a further embodiment of the invention, it is readily possible to control the feeding movement of the mandrel roll as a function of the ring diameter of a measuring control, since the rolling machine, according to the invention, permits straight feeding paths adapted to the respective blank diameter, which is a prerequisite for such a measuring control.

The rolling machine, according to the invention, offers particularly favorable conditions for the arrangement of known axial rolls for machining ring end faces insofar as a displacement of the axial roll stand radially to the mandrel roll is not necessary. On the one hand, due to the fact that displacements of the rolling platform radially to the main roll are not necessary to bring one of the mandrel rolls into rolling position and, on the other hand, due to the lowerability of the mandrel rolls and the simple type of workpiece feed. This considerably reduces the cost of construction. Of these axial rolls, at least one is driven. One axial roll is immovably mounted on the rolling machine frame, while the other can be moved in a known manner axially to the ring but is mounted stationary on the rolling machine frame radially to the mandrel roll in rolling position. A particularly simple structural arrangement for the rolling machine is obtained by an embodiment where at least one of the two axial rolls is arranged on the supporting arm for the upper support of the mandrel roll in rolling position. The stationary arrangement of the axial roll stand facilitates a fully automatic operation even with the use of axial rolls. To this end, the feeding movements of the axial rolls are controlled in dependence on the variable axial ring height.

Accordingly, it is an object of the invention to provide a multiple mandrel ring rolling machine for producing a ring from a ring blank which includes a frame, a rolling platform, means for mounting the rolling platform to the frame for rotary movement relative thereto, a main roll movably mounted on the frame above the platform, a plurality of elongated mandrel rolls, each of the mandrel rolls including a longitudinal axle having oppositely disposed ends, each of the mandrel rolls being mounted on the rolling platform for rotation about its own axle, and the mandrel rolls being axially displaceable relative to the rolling platform between a first position above the rolling platform for rolling the ring blank and a second position below the rolling platform.

It is a further object of the invention to provide a multiple mandrel ring rolling machine which is simple in design, rugged in construction and economical to manufacture.

For an understanding of the principles of the invention, reference is made to the following description of a typical embodiment thereof as illustrated in the accompanying drawings.

Figure 1:
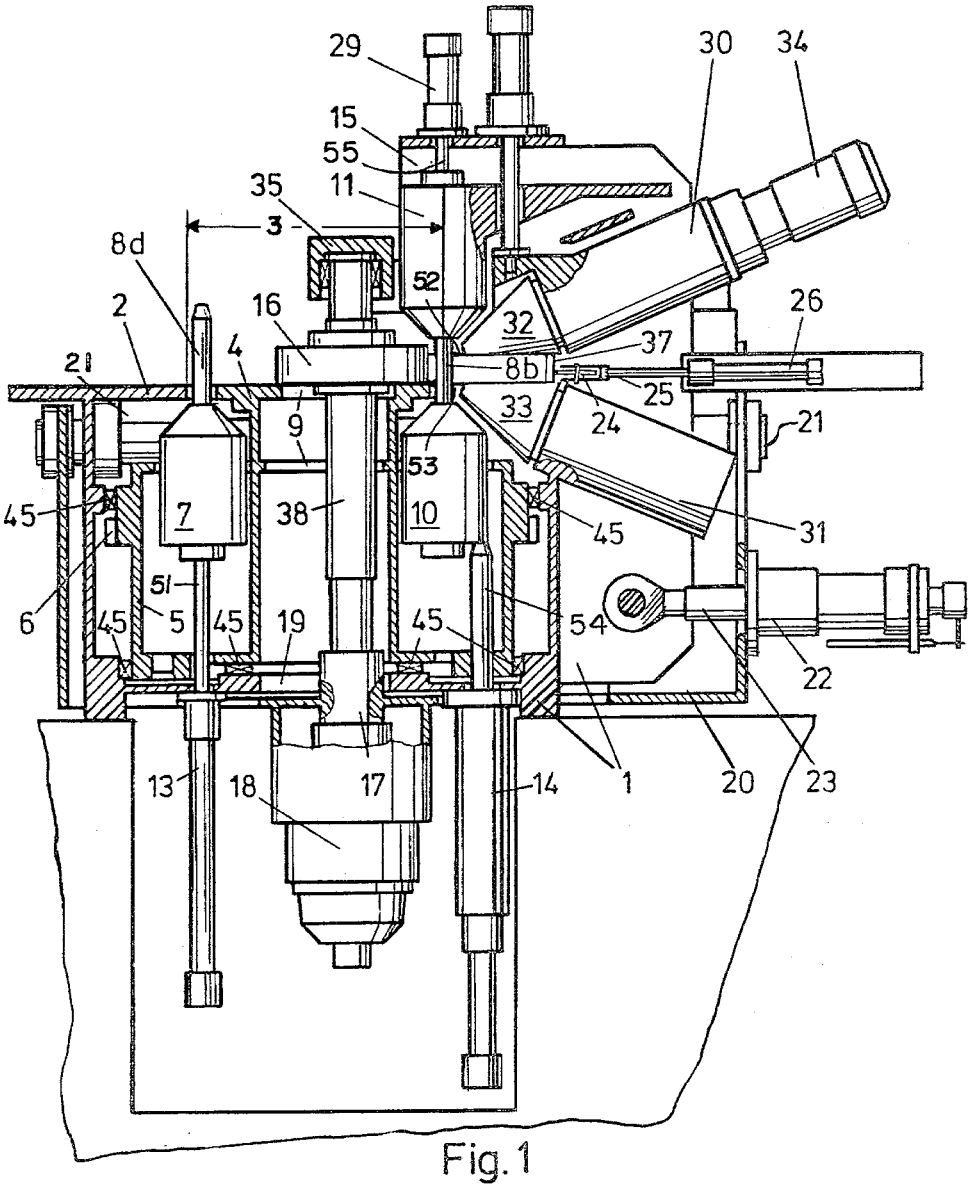
FIG. 1 illustrates a side elevation, partly in section, of a multiple-mandrel ring rolling machine, according to the invention.

The drawings illustrate a multiple mandrel ring rolling machine in accordance with the invention for hot rolling rings of a small to medium diameter, for example, roller bearing rings. The machine has a stationary rolling machine frame 1.

DETAILED DESCRIPTION OF THE DRAWINGS

A table top 2 which can receive known devices (not shown) for the automatic feeding and removal of workpieces is arranged on the stationary rolling machine frame 1. A circular opening 3 is provided in table top 2. A rotatable rolling platform 4 is disposed within opening 3. A supporting system 5 for rolling platform 4 is rotatably mounted to rolling machine frame 1 with roller bearings 45. The rolling platform can be rotated counterclockwise in ninety degree steps by a ring gear 6 mounted thereon that is operatively connected to a drive (not shown). The diameter of rolling platform 4 is made as small as possible in order to obtain small inertia forces and to shorten the ring feeding paths in the interest of short working cycles.

Lower mandrel roll bearing housings 7 and 10 are mounted on supporting system 5 in such a manner as to be displaceable in the axial direction. Elongated mandrel rolls 8*a*, 8*b*, 8*c* and 8*d*, which are displaceable in axial direction, are rotatably mounted and detachably secured in the mandrel roll bearing housings. The mandrel rolls 8*a* to 8*d* penetrate the rolling platform 4 through recesses 48 at its outer end opposite table top 2. A control cam (not shown), as well as fluid cylinders 13 and 14 are operatively connected to housings 7 and 10 so that mandrel roll bearing housings 7 and 10 can perform axial movements with mandrel rolls 8*a* to 8*d* during the rotation of rolling platform 4 in the manner described hereafter.

Figure 2:
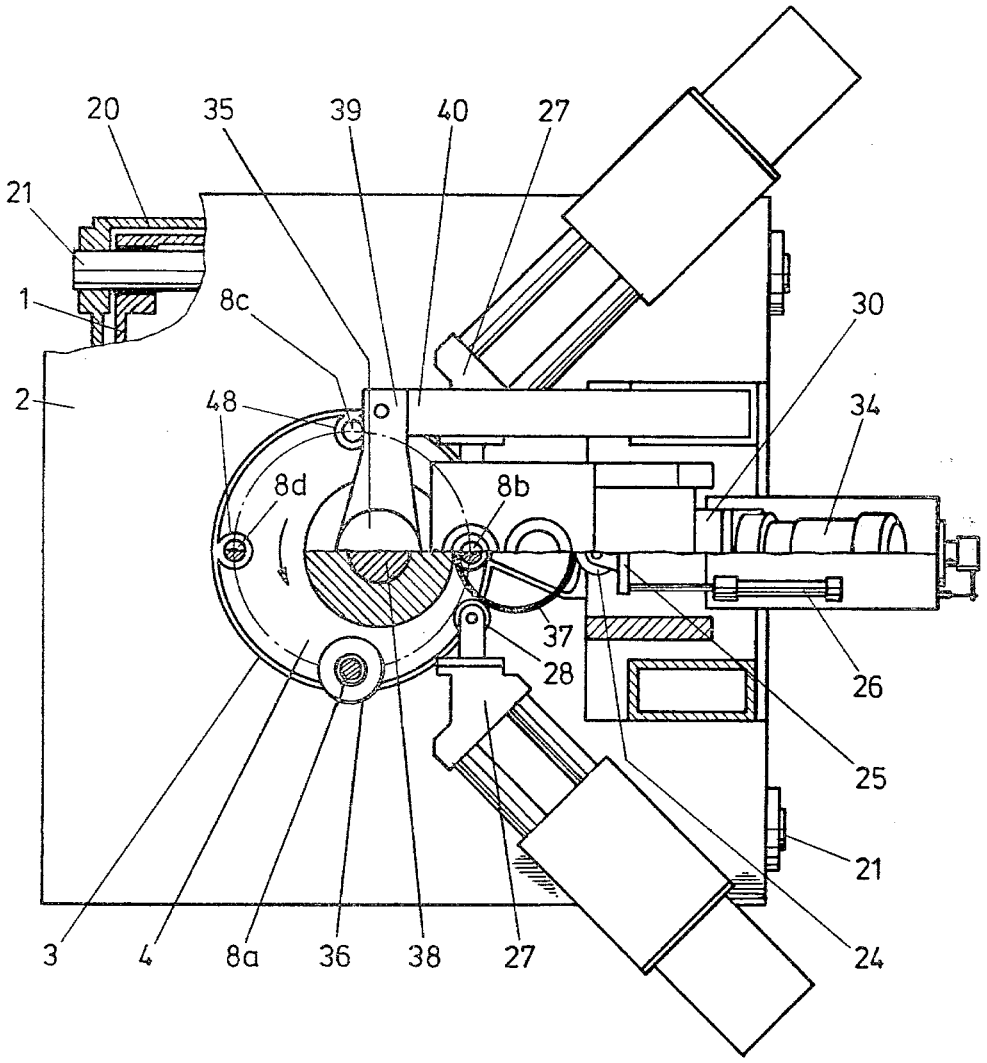
FIG. 2 illustrates a top plan view, partly broken away and partly in section, of the rolling machine of FIG. 1.

The mandrel roll 8*c*, as illustrated in the drawings, is in its unloading position, that is, in its lowest position, so that its upper end is below the level of rolling platform 4. Mandrel roll 8*c*, accordingly, will arrive during the counterclockwise rotation of rolling platform 4 in the cooling position, that is, the position in which mandrel roll 8*d* is illustrated. There, a fluid cylinder 13, having a plunger 51, is secured to rolling machine frame 1, which permits the mandrel roll bearing housing 7 to be lifted in this position above the control cam, arranged in known manner but not illustrated in the drawing for the sake of clarity, so as to move the mandrel roll into the highest position in order to be able to cool, clean and lubricate as well as to replace it. In operation, the mandrel roll bearing housing 7 is then lowered again on the control cam and clocked, by rotating platform 4, into the loading position, in which a mandrel roll 8*a* is illustrated in FIG. 2. In the loading position, a ring blank 35 is placed over the rolling platform 4 so that it is above the entire lowered mandrel roll 8*a*. At the start of the following cycle of rotation of the rolling platform, the mandrel roll 8*a* is moved upwardly, by the control cam until it penetrates through the hole of the ring blank and entrains the applied ring blank 36. The respective mandrel roll with ring blank 36 moves during this rotation cycle of rolling platform 4 into rolling position.

Another fluid cylinder 14 serves, to lift the lower mandrel roll bearing housing 10 of the mandrel roll from the control cam into the rolling position, in which mandrel roll 8*b* is illustrated, that is, into the upper end position in which the free upper end of the respective elongated mandrel roll 8*b* is received and supported within bearing (not shown) that is provided in an upper mandrel-roll bearing housing 11. After the rollng, the mandrel roll is lowered again to the control cam to a level at which it brings the rolled and finished ring 37, during the next rotating cycle of the rolling platform, into the unloading position-mandrel roll position in which 8*c* is illustrated. When the rolling platform 4 is rotated to the unloading position, the mandrel is again lowered into the lowest position and the finished ring 37 is pushed from the rolling platform.

The mandrel-roll bearing housing 11 is secured at a proper distance above rolling platform 4 on a supporting arm 15 which is immovably connected to rolling machine frame 1.

A main roll 16 is detachably mounted in a lower bearing housing 17 and rotatably mounted in an upper bearing housing 35, and driven by a drive 18. The lower bearing housing 17 and drive 18 are fixedly mounted to a carriage 20. Lower bearing housing 17 and vertical shaft 38 respectively extend through coaxial openings 9 and 19 within the rotatable rolling platform 4 and the supporting system 5. Two arms 40 are secured on carriage 20. A traverse arm 39 carrying bearing housing 35 for the main roll 16 which can be removed to permit replacement of the main roll 16 is borne by the arms 40.

Carriage 20 is displaceable on guide rods 21, in rolling machine frame 1, radially to main roll 16 and to mandrel roll which is in the rolling position. These displacements are effected by a cylinder-piston system which includes cylinder 22, fixed to carriage 20, that has piston rod 23 articulated to rolling machine frame 1. The displacements of carriage 20 are controlled during the rolling process by a known measuring control (not shown). The measuring element of the measuring control is a feeler roller 24 which is mounted in a slide 25 that permits movements of feeler roller 24 relative to carriage 20 radially to mandrel roll in rolling position that is, 8*b* as illustrated. Feeler roller 24 is coupled with a motion pickup and can be pressed onto the outer circumferential surface of ring 37 in rolling position via a fluid cylinder 26. Rotatable centering rollers 28, rotatably mounted on centering slides 27, are displaceably mounted on carriage 20 substantially radially to ring 37 in the rolling position. This unsymmetrical arrangement permits, on the one hand, maximum rigidity of the entire system and, on the other hand, unimpeded feeding of the ring blank 36 and of the finished ring 37 during the rotation of rolling platform 4. The centering slide is operated by an automatically controlled drive, which is known in itself (not shown). By means of the measuring control, ring 37 remains during the rolling process, on the one hand, in a central position with regard to the plane defined by the axes of the axles of main roll 16 and feeler roll 24, and on the other hand, is not deformed by an excessive centering force.

Supporting arm 15, rigidly secured on rolling machine frame 1, in addition to the upper mandrel roll bearing housing 11, supports a fluid cylinder 29. Fluid cylinder 29, upon being pressurized actuates a plunger 55 by which the axle of the mandrel roll in rolling position, here mandrel roll 8*b*, is disengaged from its upper bearing of housing 11, and thus starts the downward movement of the respective mandrel roll-bearing housing 10. Ring housings 30 and 31 for rotatable conical axial rollers 32 and 33 are secured on supporting arm 15. The lower axial roller 33 is stationary, while ring housing 30 of the upper axial roll 32 is mounted in known manner (not shown here) on a carriage which permits movements axially to the ring to be rolled and the exertion of necessary rolling forces on end faces 52, 53 of the ring. The upper axial roll 32 is driven by a drive 34, which is regulated in known manner automatically to the speed corresponding to the speed of the ring.

While a specific embodiment of the invention has been shown and described in detail to illustrate the application of the principles of the invention, it will be understood that the invention may be embodied otherwise without departing from such principles.

What is claimed is:

1. A multiple-mandrel ring rolling machine for producing a ring from a ring blank comprising a frame, a rolling platform, means for mounting said rolling platform to said frame for rotary movement relative thereto, a main roll movably mounted on said frame above said platform, a plurality of elongated mandrel rolls mounted below said rolling platform, each of said mandrel rolls including a longitudinal axle having oppositely disposed ends, each of said mandrel rolls being mounted on said rolling platform for rotation about its own axle, and said mandrel rolls being axially displaceable relative to said rolling platform between a first position above said rolling platform for rolling the ring blank and a second position below said rolling platform.

2. The ring rolling machine according to claim 1, wherein the rolling platform is mounted in said frame in an axially and traversely fixed position, and further comprising a carriage displaceably mounted on said frame for rectilinear movement toward and away from said first position for rolling the ring blank, said main roll being mounted in said carriage.

3. A ring rolling machine according to claim 2, further comprising a supporting arm fixedly secured on said frame at a predetermined spaced distance above said rolling platform, a bearing connected to said supporting arm for receiving an axle end of one of said mandrel rolls in said first position.

4. A ring rolling machine according to claim 3, wherein at least one of said axial rolls is arranged on said supporting arm.

5. A ring rolling machine according to claim 3, further comprising two axial rolls for machining end faces of the ring to be rolled, at least one of said axial rolls being mounted fixedly on said frame for rotaty movement relative to one of said end faces and the other of said axial rolls being axially movable to the ring, but fixedly radially in respect to the first position.

6. A ring rolling machine according to claim 2, further comprising means for controlling the movement of said carriage as a function of the diameter of the ring to be rolled.

7. A ring rolling machine according to claim 2, further comprising two axial rolls for machining end faces of the ring to be rolled, at least one of said axial rolls being mounted fixedly on said frame for rotary movement relative to one of said end faces and the other of said axial rolls being axially movable to the ring but fixedly radially in respect to the first position.

8. A ring rolling machine according to claim 1, further comprising means for controlling the movement of said carriage as a function of the diameter of the ring to be rolled.

9. A ring rolling machine according to claim 4, further comprising two axial rolls for machining end faces of the ring to be rolled, at least one of said axial rolls being mounted fixedly on said frame for rotary movement relative to one of said end faces and the other of said axial rolls being axially movable to the ring but fixedly radilly in respect to the first position.

10. A ring rolling machine according to claim 1, further comprising two axial rolls for machining end faces of the ring to be rolled, at least one of said axial rolls being mounted fixedly on said frame for rotary movement relative to one of said end faces and the other of said rolls being axially movable to the ring but fixedly radially in respect to the first position.

11. A ring rolling machine according to claim 5, further comprising means for controlling the movement of said first-mentioned axial roll in dependence to the axial height of the ring to be rolled.

12. A ring rolling machine according to claim 10, further comprising a supporting arm fixedly secured on said frame at a predetermined spaced distance above said rolling platform, a bearing connected to said supporting arm for receiving an axle end of one of said mandrel rolls in said first position and wherein at least one of said axial rolls is arranged on said supporting arm.

13. A ring rolling machine according to claim 1, further comprising means for controlling the movement of said carriage as a function of the diameter of the ring to be rolled.

* * * * *